US010894001B2

(12) United States Patent
Jarvis

(10) Patent No.: US 10,894,001 B2
(45) Date of Patent: Jan. 19, 2021

(54) PILL PULVERIZING KIT

(71) Applicant: Celia Eve Jarvis, Huber Heights, OH (US)

(72) Inventor: Celia Eve Jarvis, Huber Heights, OH (US)

( * ) Notice: Subject to any disclaimer, the term of this patent is extended or adjusted under 35 U.S.C. 154(b) by 198 days.

(21) Appl. No.: 16/145,150

(22) Filed: Sep. 27, 2018

(65) Prior Publication Data

US 2019/0091105 A1 Mar. 28, 2019

Related U.S. Application Data

(60) Provisional application No. 62/563,843, filed on Sep. 27, 2017.

(51) Int. Cl.

| | |
|---|---|
| ***A61J 7/00*** | (2006.01) |
| ***B02C 19/20*** | (2006.01) |
| ***B02C 19/00*** | (2006.01) |

(52) U.S. Cl.

CPC ..... *A61J 7/0007* (2013.01); *A61J 7/0046* (2013.01); *B02C 19/20* (2013.01); *B02C 19/0056* (2013.01)

(58) Field of Classification Search

CPC ..... A61J 7/0007; A61J 7/0046; A61J 7/0015; B02C 19/20; B02C 19/0056

USPC ..... 241/169, DIG. 27

See application file for complete search history.

(56) References Cited

U.S. PATENT DOCUMENTS

| | | | | |
|---|---|---|---|---|
| 4,212,430 A * | 7/1980 | Dale | B02C 7/00 241/89.4 |
| 4,366,930 A * | 1/1983 | Trombetti, Jr. | A61J 7/0007 241/169 |
| 7,198,167 B2 * | 4/2007 | Marsden | A47G 19/2272 206/538 |

* cited by examiner

*Primary Examiner* — Shelley M Self
*Assistant Examiner* — Teresa A Guthrie

(57) ABSTRACT

A pill pulverizing kit is a system that contains, processes, and subsequently dispenses pills and similar hard medications. The system includes a tubular receptacle, a crushed-pill repository, and a plurality of pill-processing devices. The tubular receptacle is a container utilized as the primary housing for pills both before and after pulverizing, as well as the housing for the components involved in crushing and consumption. The crushed-pill repository is a curved indent that collects and contains crushed pill material until the user is prepared to consume or serve the pill powder. The plurality of pill-processing devices relates to a series of removable additions to the tubular receptacle that provide various functions, including pill pulverization and content dispensing and consumption. The plurality of pill-processing devices includes a lid for consumption, as well as an impact driving mechanism that generates power and force for pulverizing pills.

8 Claims, 7 Drawing Sheets

PILL PULVERIZING KIT

The current application claims a priority to the U.S. Provisional Patent application Ser. No. 62/563,843 filed on Sep. 27, 2017.

FIELD OF THE INVENTION

The present invention relates generally to a medication preparation device. More specifically, the pill pulverizing kit crushes hard pills for facilitated processing and oral delivery of medication. An impact driving mechanism pulverizes solid pill material, while a lid with multiple openings is provided to enable usage of the present invention as a drinking cup.

BACKGROUND OF THE INVENTION

Many people suffer from difficulty swallowing pills. This difficulty can be the result of complications such as a soft or softening esophagus. Certain medical conditions may restrict the ability of throat muscles to operate properly. Elderly people in particular tend to have weakened or deteriorated throat muscles and esophageal passages, resulting in increased difficulty in ingestion of hard foods and consumables. This issue is commonly found in the very young populations as well, whose throats have not yet developed enough control to properly swallow pills. The inability to swallow pills may result in the exacerbation of an individual's medical condition, or worse yet, may result in an individual choking during ingestion attempts.

To this end, a variety of pill-crushing or modifying devices have been developed. These devices aid in the swallowing process by reducing the size of the hard material to be ingested. Such grinding and crushing tools have the capacity to reduce a pill to powder form; however, these devices tend to have several drawbacks. Many such devices require a firm, strong hand in order to operate them. This is not practical for any of the elderly, the young, or the sick, unless they have capable assistants nearby. Further, many such tools do not provide an adequate collection and evacuation method. Grinding a pill into a powder is not effective if the full pill mass cannot be subsequently consumed. Many elderly and sick people cannot get the appropriate dose of a pill due to the inability to effectively crush a pill and retrieve the pulverization results. What is needed is a pill pulverizing tool that is easy to operate without a large amount of strength. Further desirable is a tool that provides an easy, accessible mechanism for collecting and subsequently retrieving or consuming pill material.

The present invention addresses these issues. The pill pulverizing kit is designed to aid people who have difficulty swallowing a variety of pills. The premise of this system is that it allows the user to mix the pulverized pill or pills with a liquid, so an individual can easily consume their medication in liquid form. The user may similarly sprinkle the pulverized pill or pills onto food for intake. The present invention is appropriate for home, medical facility, rehabilitation facility, nursing home, hospice and long-term care facility use; however, anyone can use the present invention as desired. Adult supervision is encouraged when used by a minor or individuals with special needs due to the sharp and moving parts of the present invention. No special training is required to operate the present invention, further improving the practicality of the present invention relative to other devices attempting to achieve the same goal of pill pulverization and facilitated medicine consumption.

DETAILED DESCRIPTION OF THE INVENTION

All illustrations of the drawings are for the purpose of describing selected versions of the present invention and are not intended to limit the scope of the present invention.

Figure 1:
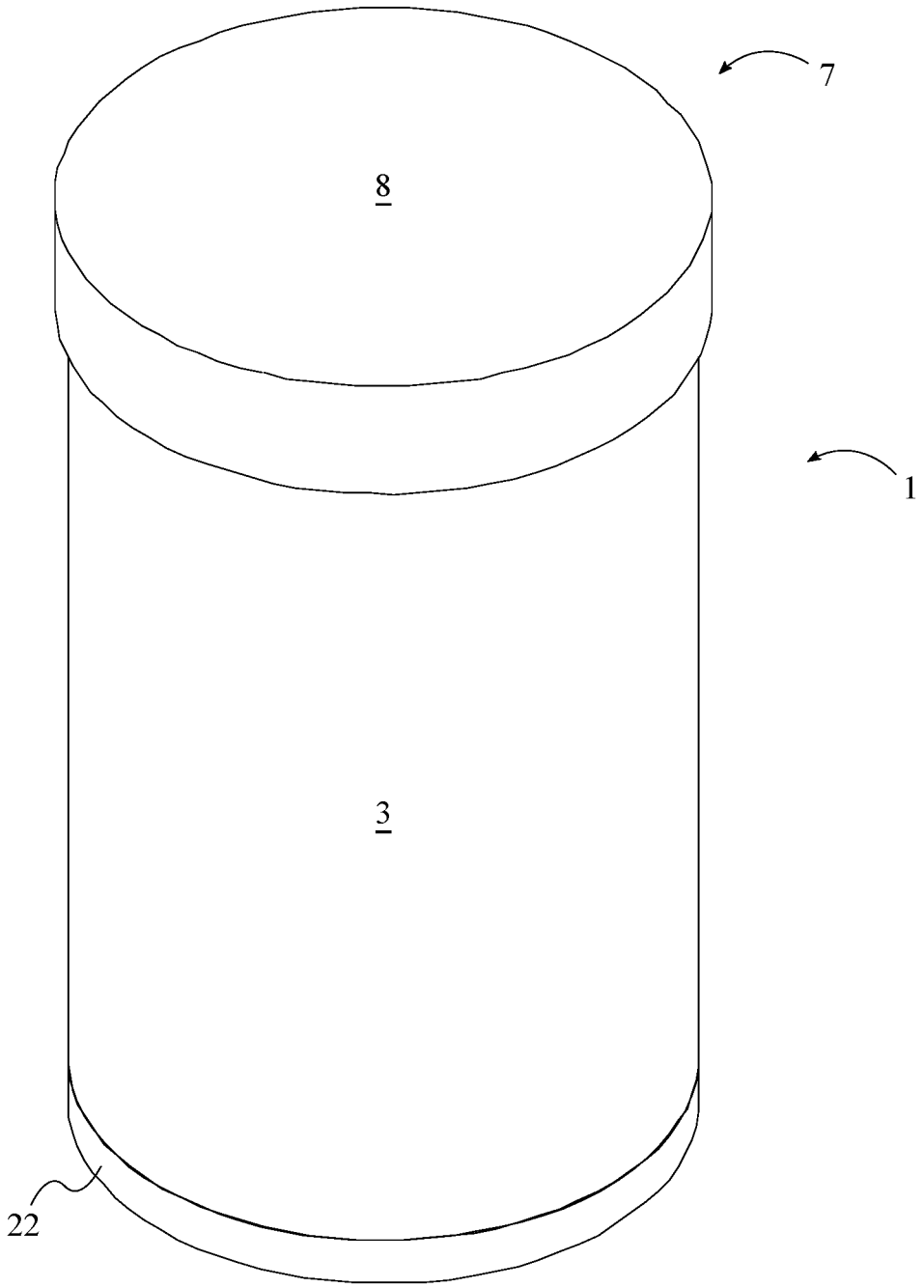
FIG. 1 is a front-top perspective view of the present invention with the impact driving mechanism.

The present invention relates generally to a mechanism for containing, processing, and subsequently dispensing pills and similar hard medications. The present invention is further configured to allow for consumption of medicinal material in liquid form in order to ensure that the fully-ground contents of the present invention are utilized. The present invention comprises a tubular receptacle 1, a crushed-pill repository 6, and a plurality of pill-processing devices 7, as seen in FIG. 1. The tubular receptacle 1 is a container utilized as the primary housing for pills both before and after pulverizing, as well as the housing for the components involved in crushing and consumption. The crushed-pill repository 6 is a curved indent that collects and contains crushed pill material until the user is prepared to consume or serve the pill powder. The plurality of pill-processing devices 7 relates to a series of removable additions to the tubular receptacle 1 that provide various functions, including pill pulverization and content dispensing and consumption.

Figure 3:
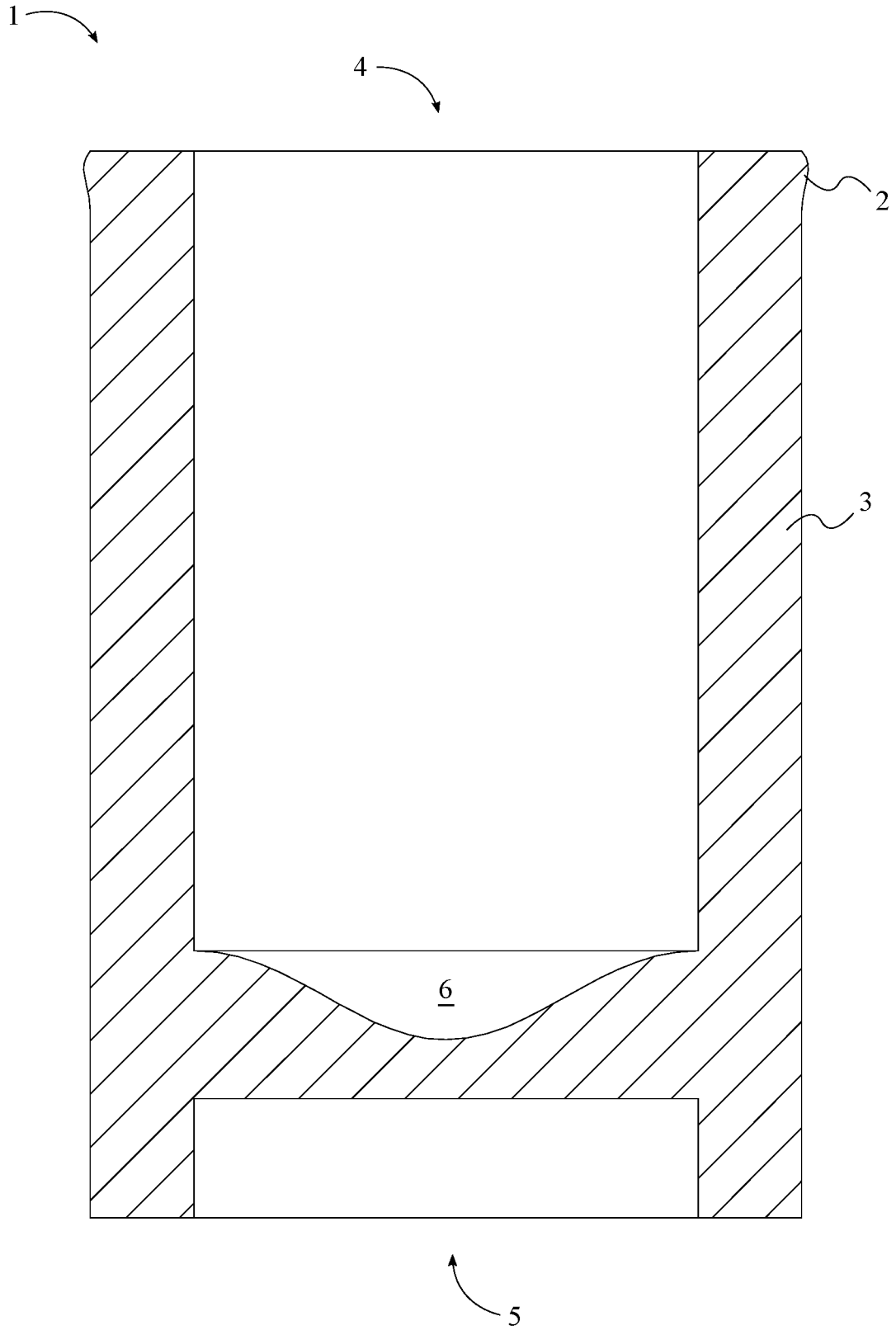
FIG. 3 is a front cross-sectional view of the tubular receptacle.

The general configuration of the aforementioned components allows the present invention to efficiently and effectively contain and process medications to convert them from solid pill form to easily-consumable powder form. The tubular receptacle 1 comprises a first fastener piece 2, a lateral wall 3, an open end 4, and a closed end 5, as seen in FIG. 3. The first fastener piece 2 is a connector that prevents undesirable movement of the plurality of pill-processing devices 7 relative to the tubular receptacle 1. The lateral wall 3 is a curved tubular surface that defines the lateral space available within the tubular receptacle 1. The open end 4 is a segment of the tubular receptacle 1 through which pills, the plurality of pill-processing devices 7, and other contents may be combined for pulverizing and mixing. The closed end 5 is the segment of the tubular receptacle 1 which keeps contents from falling out of the tubular receptacle 1 during use. Further, each of the plurality of pill-processing devices 7 comprises a second fastener piece 14. The second fastener piece 14 provides an appropriate mechanism for engagement of the plurality of pill-processing devices 7 to the first fastener piece 2.

In order to retain the plurality of pill-processing devices 7, along with pills and fluids contained within the tubular receptacle 1, the arrangement of components within the tubular receptacle 1 is critical. To optimize available space and ensure the present invention functions during use over time, the open end 4 and the closed end 5 are positioned opposite to each other along the lateral wall 3. This arrangement allows for subsequent arrangement of components. The crushed-pill repository 6 is integrated into the closed end 5, as seen in FIG. 3. In this way, the crushed-pill repository 6 is optimally placed for receiving ground or crushed pill material. The first fastener piece 2 is connected around the lateral wall 3, adjacent to the open end 4. This arrangement allows for the plurality of pill-processing devices 7 to connect at the open end 4 of the tubular receptacle 1. A selected device from the plurality of pill-processing devices 7 is operatively coupled to the tubular receptacle 1, wherein the selected device is used to modify or dispense contents of the tubular receptacle 1. In this way, the plurality of pill-processing devices 7 can interact with the contents of the tubular receptacle 1, allowing for both grinding and consumption or further processing. Furthermore, the first fastener piece 2 is engaged to the second fastener piece 14 of the selected device. This arrangement prevents the plurality of pill-processing devices 7 from shifting or moving during use, which could cause pulverizing inefficiencies or spills.

Figure 2:
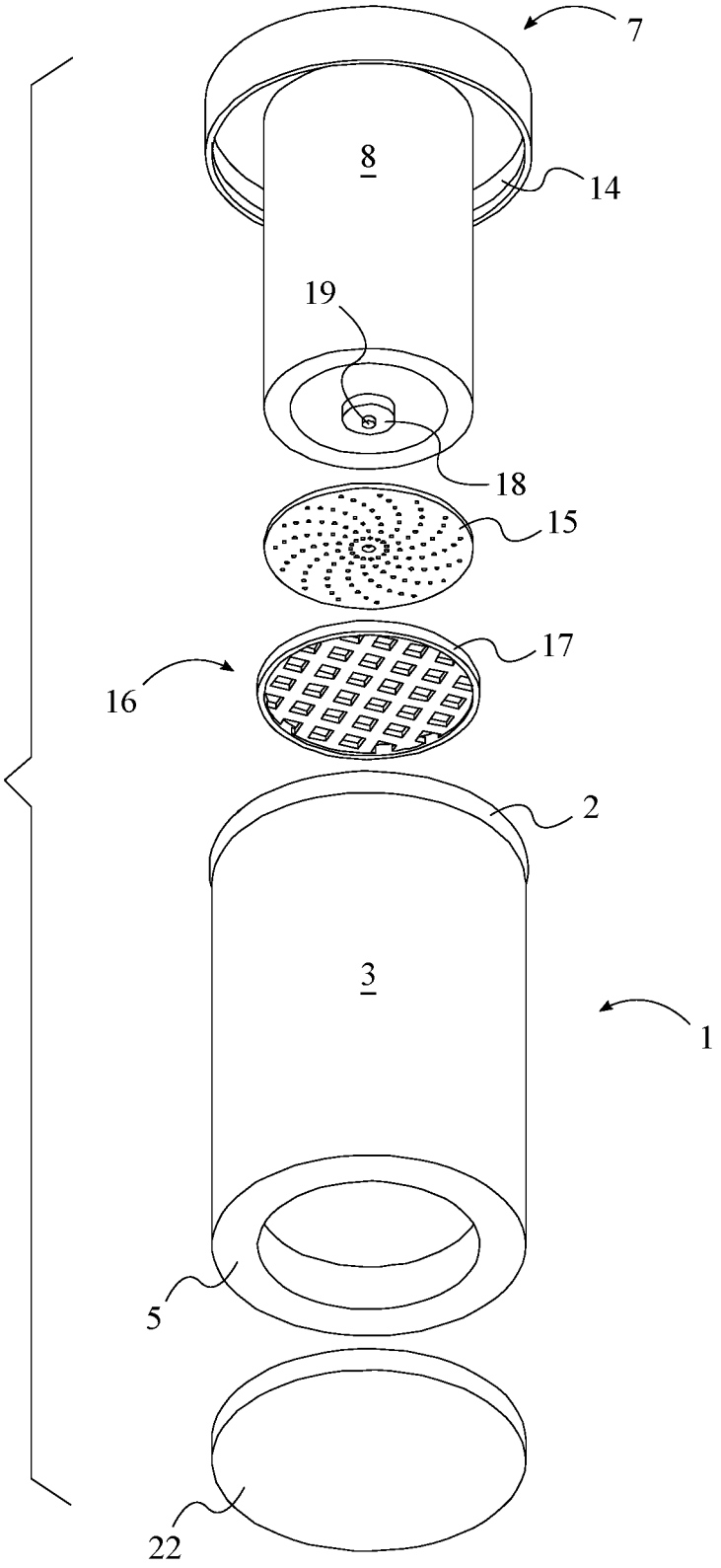
FIG. 2 is an exploded front-bottom perspective view of the present invention with the impact driving mechanism.

The present invention must be properly-equipped to grind and crush any solid material. To this end, an exemplary embodiment of the present invention has the selected device being an impact driving mechanism 8. The impact driving mechanism 8 utilizes motors, pulleys, and other such components to generate translational and torsional forces. Further, manual switches or controls may be utilized to provide the user with a means of toggling the on/off state of the present invention, thus preventing users from having to apply heavy forces themselves. In this embodiment, the present invention further comprises a grinding wheel 15 and a grate 16, as seen in FIG. 2. The grinding wheel 15 is a disc with several radially-distributed sharp edges or blades that capable of reducing a hard pill or pills to powder. The grate 16 is a rigid mesh surface that allows for support and positioning of pills relative to the grinding wheel 15. The grate 16 and the grinding wheel 15 are positioned within the tubular receptacle 1. In this way, contents to be pulverized are confined to the space within the tubular receptacle 1. The grate 16 is coextensive with the lateral wall 3. Furthermore, the grate 16 is positioned in between the closed end 5 and the grinding wheel 15. This arrangement ensures that no pill material can pass into the crushed-pill repository 6 without being ground to acceptable particle size. The impact driving mechanism 8 is operatively mounted to the grinding wheel 15, wherein the impact driving mechanism 8 is used to rotatably and linearly actuate the grinding wheel 15. In this way, the grinding wheel 15 may rotate and translate with force and torque generated by the impact driving mechanism 8. This arrangement allows for crushing of all pill material placed within the tubular receptacle 1.

Pill material may have a tendency to slide about the present invention between the grinding wheel 15 and the grate 16, and in particular may slide radially away from the center of the grinding wheel 15. To counteract this effect, the present invention comprises a retention wall 17, as seen in FIG. 2. The retention wall 17 prevents pills from sliding out from between the grinding wheel 15 and the grate 16. The retention wall 17 is peripherally positioned around the grinding wheel 15. This arrangement prevents pill movement and further enables the grinding wheel 15 to move closer to and further from the grate 16 without potential pill material loss. The retention wall 17 is connected onto the grate 16. This arrangement ensures that pill material is retained atop the grate 16 during all translational and torsional motion of the grinding wheel 15.

In an exemplary embodiment of the present invention, the user may wish to remove the grinding wheel 15 for cleaning and maintenance. It is beneficial for the grinding wheel 15 to be made more accessible by offsetting the grinding wheel 15 from the impact driving mechanism 8. To this end, the present invention further comprises an offsetting axle 18 and a wheel mount 19, as seen in FIG. 2. The offsetting axle 18 allows for space between the grinding wheel 15 and the impact driving mechanism 8. The wheel mount 19 allows for removable connection of the grinding wheel 15. Moreover, the impact driving mechanism 8 is operatively coupled to the offsetting axle 18, wherein the impact driving mechanism 8 is used to rotatably and linearly actuate the offsetting axle 18. In this way, motion from the impact driving mechanism 8 is transmitted through the offsetting axle 18. The impact driving mechanism 8 is terminally positioned to the offsetting axle 18. Concentric positioning of the offsetting axle 18 ensures that the grinding wheel 15 is centered relative to the impact driving mechanism 8. The wheel mount 19 is terminally connected to the offsetting axle 18, opposite the impact driving mechanism 8. This ultimately allows for optimal positioning of the grinding wheel 15 relative to the impact driving mechanism 8. The grinding wheel 15 is torsionally connected to the wheel mount 19. This arrangement allows the grinding wheel 15 to operate according to the motion of the impact driving mechanism 8, while reducing friction otherwise generated by contact of the grinding wheel 15 with the impact driving mechanism 8.

Figure 4:
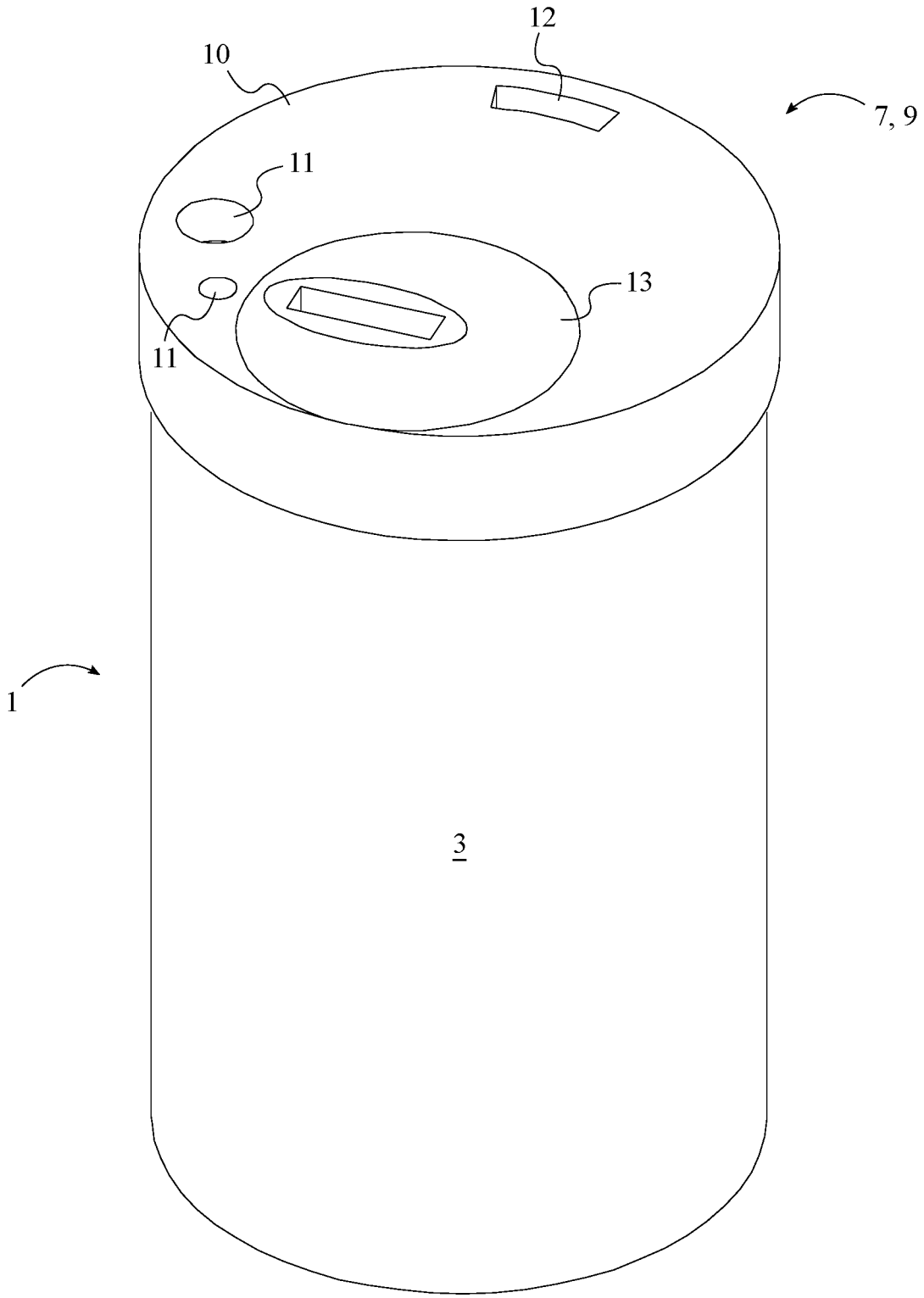
FIG. 4 is a front-top perspective view of the present invention with the lid.

The present invention must be further equipped to handle dispensing and any subsequent processing of the contents of the tubular receptacle 1. To this end, an exemplary embodiment of the present invention has the selected device being a lid 9. The lid 9 is a rigid unit that prevents contained material from accidentally spilling or evacuating the tubular receptacle 1. The lid 9 comprises a lid body 10 and a plurality of dispensing apertures 11, as seen in FIG. 4. The lid body 10 is the main containment apparatus of the lid 9. The plurality of dispensing apertures 11 is a series of holes or cuts into the lid body 10 of various shapes, sizes, and functions. Each of the plurality of dispensing apertures 11 traverses through the lid body 10. This allows the user to access the contents of the tubular receptacle 1 as desired. The plurality of dispensing apertures 11 is distributed around the lid body 10. This arrangement prevents contents from spilling through the wrong aperture of the plurality of dispensing apertures 11.

Figure 5:
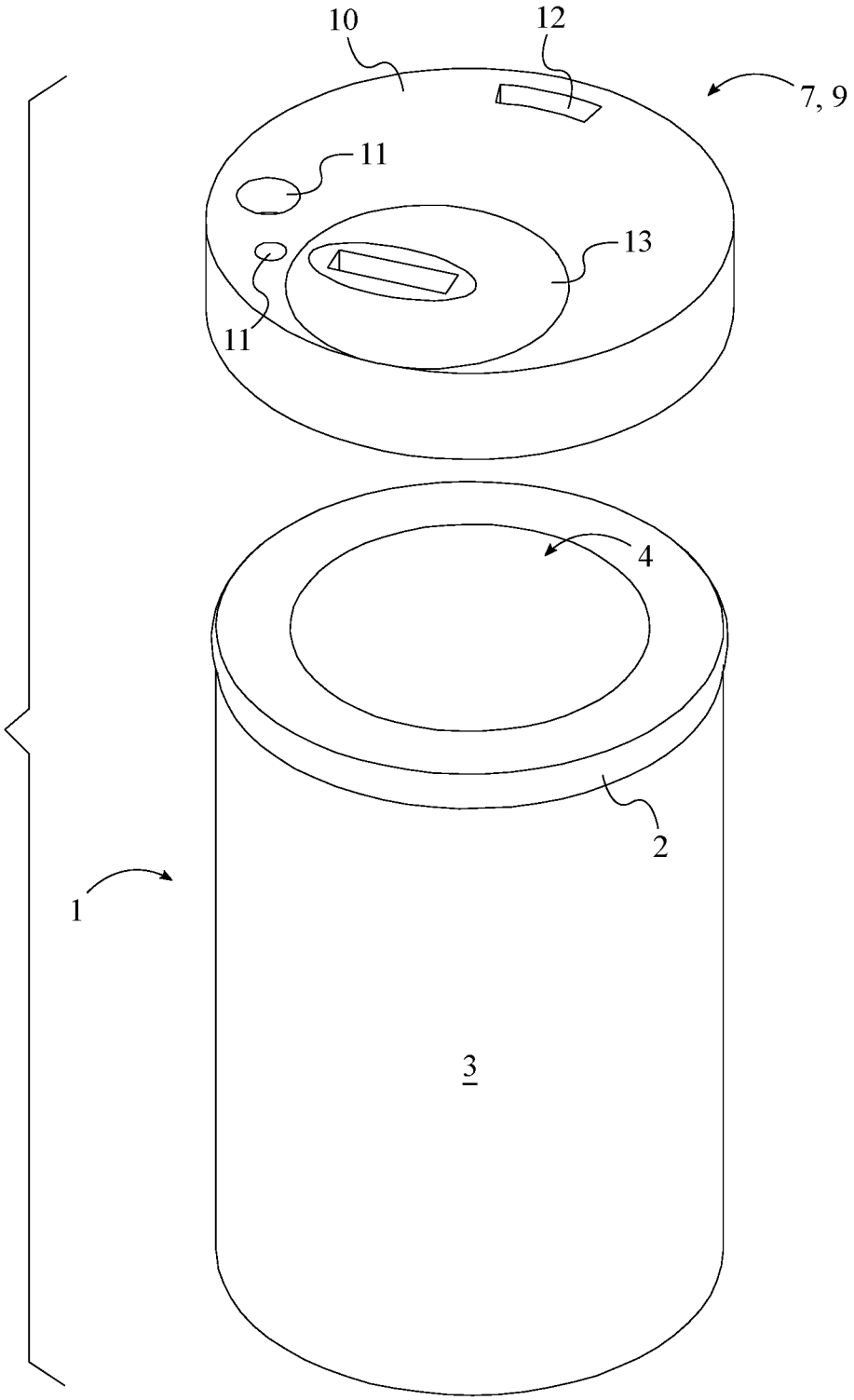
FIG. 5 is an exploded front-top perspective view of the present invention with the lid.

The plurality of dispensing apertures 11 provides a variety of different access means, each serving a unique purpose. The plurality of dispensing apertures 11 comprises a pouring spout 12 and a drinking spout 13, as seen in FIG. 5. The pouring spout 12 is a radial cut into the lid body 10 that provides an optimal way to pour contents of the tubular receptacle 1 into another container or cup. The drinking spout 13 is a lofted extrusion shaped to facilitate consumption of contents of the tubular receptacle 1 directly from the tubular receptacle 1. The drinking spout 13 is oriented away from the tubular receptacle 1. This arrangement improves the comfort of drinking or consuming contents of the tubular receptacle 1 directly from the tubular receptacle 1. The pouring spout 12 and the drinking spout 13 are positioned opposite to each other about the lid body 10. This arrangement ensures that the contents of the tubular receptacle 1 do not exit through the wrong plurality of dispensing apertures 11. Further, in the embodiment in which a user has added liquid to the tubular receptacle 1 to generate a drink from the pulverized pills, this arrangement allows air to enter the unused plurality of dispensing apertures 11, thus providing a smooth fluid flow from the tubular receptacle 1. In alternative embodiments, the plurality of dispensing apertures 11 may further include a variety of alternative openings, including straw holes, air holes, and more.

Figure 6:
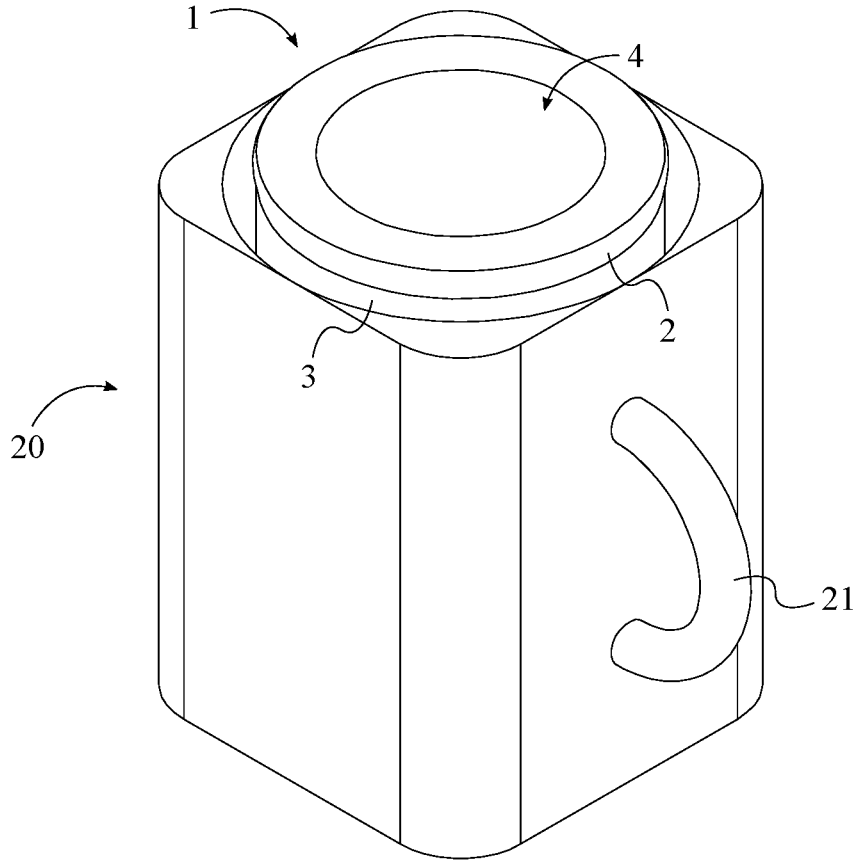
FIG. 6 is a front-top perspective view of the present invention with the cupping receptacle.
Figure 7:
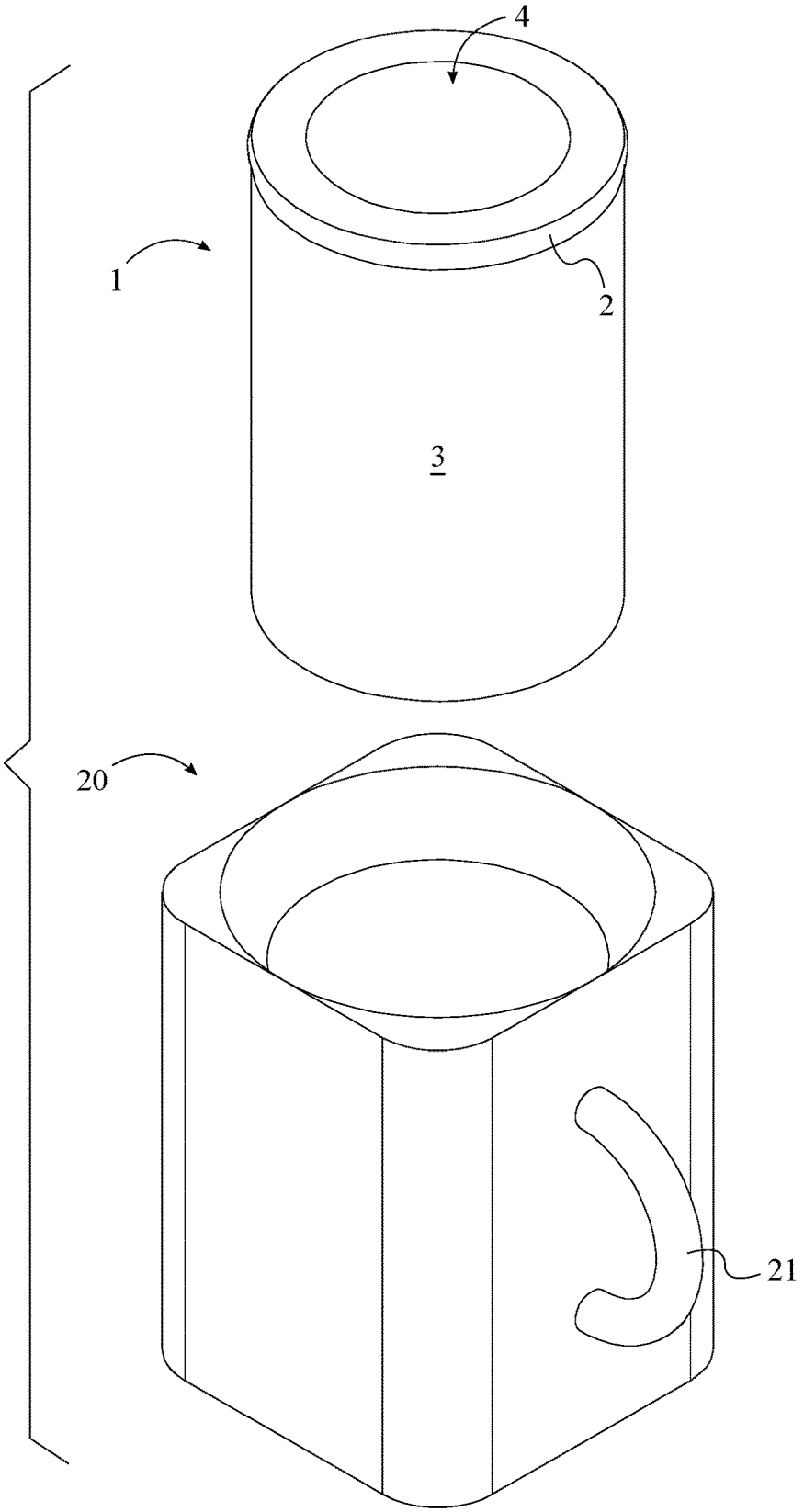
FIG. 7 is an exploded front-top perspective view of the present invention with the cupping receptacle.

The present invention is further equipped to facilitate direct consumption from the tubular receptacle 1. The present invention comprises a cupping receptacle 20 and a handle 21, as seen in FIG. 6. The cupping receptacle 20 is a container used to hold the tubular receptacle 1. The handle 21 is a curved unit that facilitates grasping of the present invention. The tubular receptacle 1 is slidably engaged within the cupping receptacle 20. This allows the user to store and remove the tubular receptacle 1 from the cupping receptacle 20. The handle 21 is laterally connected to the cupping receptacle 20, as seen in FIG. 7. This positioning allows the user to optimally grasp the cupping receptacle 20 for use. In exemplary embodiments, several ancillary handles may be utilized to provide multiple grasping mechanisms.

The tubular receptacle 1 and the plurality of pill-processing devices 7 are ideally fixed during use, preventing undesirable motion, and simultaneously easy to remove and swap for different uses. To this end, in an exemplary embodiment, the first fastener piece 2 is an annular ridge, as seen in FIG. 7. This provides the first fastener piece 2 a way to interact with the second fastener piece 14. The second fastener piece 14 is an annular channel. This arrangement provides an optimal interaction surface for the first fastener piece 2. The annular channel is positioned around the annular ridge. Further, the annular channel is engaged by the annular ridge. In this way, the plurality of pill-processing devices 7 is adequately restricted in motion for use.

During use of the present invention in the embodiment in which the plurality of pill-processing devices 7 is an impact driving mechanism 8, the present invention may shake or move undesirably. To this end, the present invention comprises a weighted base 22, as seen in FIG. 2. The weighted base 22 is a removable adapter that increases the mass of the present invention, thus reducing or preventing unintended motion. The weighted base 22 is connected adjacent to the closed end 5, opposite the lateral wall 3. This arrangement enables the weighted base 22 to support the present invention during use, while allowing the user to remove the weighted base 22 in the embodiment in which the plurality of pill-processing devices 7 is a lid 9.

Although the invention has been explained in relation to its preferred embodiment, it is to be understood that many other possible modifications and variations can be made without departing from the spirit and scope of the invention as hereinafter claimed.

What is claimed is:

1. A pill pulverizing kit comprises:
- a tubular receptacle;
- a crushed-pill repository;
- a plurality of pill-processing devices;
- a cupping receptacle;
- a handle;
- the tubular receptacle comprises a first fastener piece, a lateral wall, an open end, and a closed end;
- each of the plurality of pill-processing devices comprises a second fastener piece;
- the open end and the closed end being positioned opposite to each other along the lateral wall;
- the crushed-pill repository being integrated into the closed end;
- the first fastener piece being connected around the lateral wall, adjacent to the open end;
- a selected device from the plurality of pill-processing devices being operatively coupled to the tubular receptacle, wherein the selected device is used to modify or dispense contents of the tubular receptacle;
- the first fastener piece being engaged to the second fastener piece of the selected device;
- the tubular receptacle being slidably engaged within the cupping receptacle; and
- the handle being laterally connected to the cupping receptacle.

2. The pill pulverizing kit as claimed in claim 1 comprises:
- a grinding wheel;
- a grate;
- the selected device being an impact driving mechanism;
- the grate and the grinding wheel being positioned within the tubular receptacle;
- the grate being coextensive with the lateral wall;
- the grate being positioned in between the closed end and the grinding wheel; and
- the impact driving mechanism being operatively mounted to the grinding wheel, wherein the impact driving mechanism is used to rotatably and linearly actuate the grinding wheel.

3. The pill pulverizing kit as claimed in claim 2 comprises:
- a retention wall;
- the retention wall being peripherally positioned around the grinding wheel; and
- the retention wall being connected onto the grate.

4. The pill pulverizing kit as claimed in claim 2 comprises:
- an offsetting axle;
- a wheel mount;
- the impact driving mechanism being operatively coupled to the offsetting axle, wherein the impact driving mechanism is used to rotatably and linearly actuate the offsetting axle;
- the impact driving mechanism being terminally positioned to the offsetting axle;
- the wheel mount being terminally connected to the offsetting axle, opposite the impact driving mechanism; and
- the grinding wheel being torsionally connected to the wheel mount.

5. The pill pulverizing kit as claimed in claim 1 comprises:
- the selected device being a lid;
- the lid comprises a lid body and a plurality of dispensing apertures;
- each of the plurality of dispensing apertures traversing through the lid body; and
- the plurality of dispensing apertures being distributed around the lid body.

6. The pill pulverizing kit as claimed in claim 5 comprises:
- the plurality of dispensing apertures comprises a pouring spout and a drinking spout;
- the drinking spout being oriented away from the tubular receptacle; and the pouring spout and the drinking spout being positioned opposite to each other about the lid body.

7. The pill pulverizing kit as claimed in claim 1 comprises:

the first fastener piece being an annular ridge;

the second fastener piece being an annular channel;

the annular channel being positioned around the annular ridge; and the annular channel being engaged by the annular ridge.

8. The pill pulverizing kit as claimed in claim 1 comprises:

a weighted base;

the weighted base being connected adjacent to the closed end, opposite the lateral wall.

* * * * *